US005358171A

United States Patent [19]

Focke

[11] Patent Number: 5,358,171

[45] Date of Patent: Oct. 25, 1994

[54] PACK FOR RECEIVING HANDKERCHIEFS, BLANK FOR THE PACK AND PROCESS FOR PRODUCING SUCH A PACK

[75] Inventor: Heinz Focke, Verden, Fed. Rep. of Germany

[73] Assignee: Focke & Co. (GmbH & Co.), Verden, Fed. Rep. of Germany

[21] Appl. No.: 10,052

[22] Filed: Jan. 28, 1993

[30] Foreign Application Priority Data

Jan. 28, 1992 [DE] Fed. Rep. of Germany ..... 4202258

[51] Int. Cl.[5] ..... B65D 5/54

[52] U.S. Cl. ..... 229/87.05; 206/264; 206/494; 229/243; 229/244

[58] Field of Search ..... 206/264, 494; 229/87.05, 223, 243, 244

[56] References Cited

U.S. PATENT DOCUMENTS

| | | | |
|---|---|---|---|
| 2,442,699 | 6/1948 | Locke, Jr. | 229/223 |
| 2,767,900 | 10/1956 | Bouteloup | 206/264 |
| 3,276,668 | 10/1966 | Tamarin | 206/264 |
| 3,557,853 | 1/1971 | Jones . | |
| 4,062,486 | 12/1977 | Goodrich | 229/223 |
| 4,141,449 | 2/1979 | Stone | 229/223 |
| 4,375,260 | 3/1983 | Focke et al. | 206/264 |
| 4,460,088 | 7/1984 | Rugenstein et al. | 206/264 |
| 4,790,436 | 12/1988 | Nakamura . | |
| 5,018,625 | 5/1991 | Focke et al. | 229/87.05 |
| 5,029,712 | 7/1991 | O'Brien et al. | 229/87.05 |
| 5,096,113 | 3/1992 | Focke | 229/87.05 |

FOREIGN PATENT DOCUMENTS

| | | | |
|---|---|---|---|
| 293360 | 11/1988 | European Pat. Off. . | |
| 392224 | 10/1990 | European Pat. Off. . | |
| 401621 | 12/1990 | European Pat. Off. . | |
| 419770 | 4/1991 | European Pat. Off. . | |
| 545136 | 6/1993 | European Pat. Off. | 206/264 |
| 7539076 | 12/1975 | Fed. Rep. of Germany . | |
| 2854443 | 7/1980 | Fed. Rep. of Germany . | |
| 2949496 | 6/1981 | Fed. Rep. of Germany . | |
| 3324490 | 11/1984 | Fed. Rep. of Germany . | |
| 8319608.0 | 12/1984 | Fed. Rep. of Germany . | |
| 8319608 | 12/1984 | Fed. Rep. of Germany . | |
| 3514943 | 7/1988 | Fed. Rep. of Germany . | |
| 9003110.5 | 6/1990 | Fed. Rep. of Germany . | |
| 9006537 | 9/1990 | Fed. Rep. of Germany . | |
| 3920065 | 10/1990 | Fed. Rep. of Germany . | |
| 4134567 | 1/1993 | Fed. Rep. of Germany | 229/87.05 |

*Primary Examiner*—Gary E. Elkins
*Attorney, Agent, or Firm*—Sughrue, Mion, Zinn, Macpeak & Seas

[57] ABSTRACT

Packs for paper handkerchiefs usually comprise a wrapper of thin plastic foil and can be reclosed after the initial opening of the pack with the aid of an adhesive tape which is applied to the pack. The invention intends to create a pack with a wrapper which is as harmless to the environment as possible and is easy to handle and, optionally repeatedly reclosable. According to the invention, a closure tab (30) which covers a withdrawal opening (40) in the region of a front panel (13) of the pack (11) is connected to a portion of edges of the withdrawal opening (residual connection 32 ) in a tearable manner to permit an opening of the pack. Furthermore, the invention relates to a blank for forming the pack and a corresponding process.

17 Claims, 3 Drawing Sheets

PACK FOR RECEIVING HANDKERCHIEFS, BLANK FOR THE PACK AND PROCESS FOR PRODUCING SUCH A PACK

BACKGROUND OF THE INVENTION

The invention relates to a pack, especially a cuboid pack, for receiving a stack of (paper) handkerchiefs made of paper, parchment, thin cardboard, foil or the like, having a front panel, a rear panel, side panels, an end panel, a bottom panel and a closure tab which covers a withdrawal opening at least in the region of the front panel, which closure tab is connected to pack parts which form the end panel and at least partially covers edges of the withdrawal opening. The invention further relates to a blank, especially for forming said pack, and a process for producing a pack, especially from such a blank.

So-called paper handkerchiefs are conventionally packed in bundles of usually ten handkerchiefs in a wrapper of plastic foil or paper. The handkerchiefs should be protected against external influences until they are withdrawn. At the same time, the initial opening of the pack should be easy and permit a reclosure. Moreover, the pack should be ecologically harmless, i.e. there should remain as little waste as possible after all handkerchiefs have been used. A pack having the features mentioned at the beginning is known from DE-U-83 19 608.0.

SUMMARY OF THE INVENTION

It is the object of the present invention to further improve the described pack with regard to the mentioned criteria. In particular, it is intended to create a pack which is particularly suitable for a wrapper made of paper or similar materials.

According to the invention, this object is attained by providing a connection between the closure tab and a portion of the edges of the withdrawal opening which connection is tearable to permit an opening of the pack. Optionally, the pack may comprise an adhesive connection between the closure tab and the edges of the withdrawal opening, especially a durable adhesive connection which permits a reclosure of the pack, preferably formed from a so-called hot-melt. The pack according to the invention is easy to open, offers good protection for the contents and is particularly harmless to the environment since the wrapper can be made from paper.

Expediently, the tearable connection (connection line) is formed in a lower region of the withdrawal opening, especially in a region which is located opposite the end panel which adjoins the front panel. As a result, the effect of the force applied at the time of the initial opening of the pack is favourable.

Additional features of the invention are described in further claims and relate, inter alia, to the specific arrangement and design of the closure tab. The blank according to the invention for forming the pack according to the invention and the process for producing the pack are also described in further claims.

Particularly advantageous embodiments are described below in detail with reference to the drawings, in which:

DESCRIPTION OF PREFERRED EMBODIMENT

Figure 1:
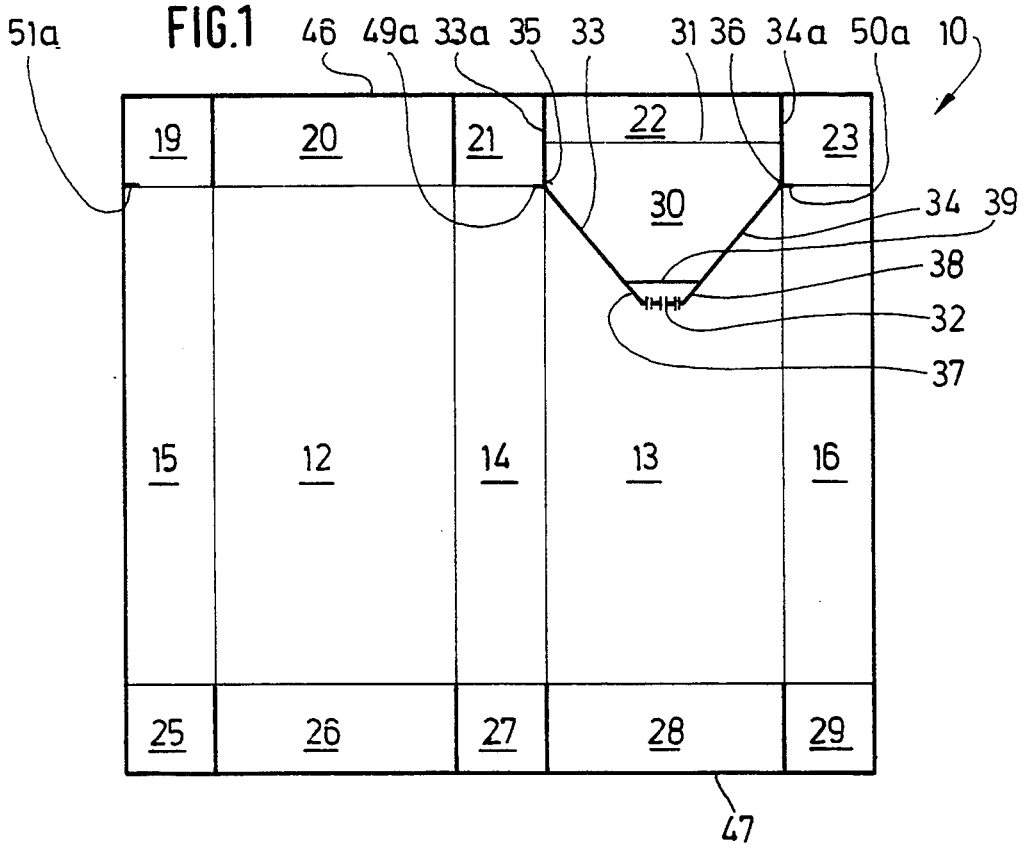
FIG. 1 shows a blank according to the invention for a pack according to the invention.

The blank 10 for forming a pack 11 according to the invention as illustrated in FIG. 1 has a rectangular basic shape. The largest surfaces within the blank 10 are a rear panel 12 and a front panel 13 which are connected to one another by a long narrow side panel 14. Longitudinal tabs 15, 16 for forming a side panel 17 located opposite the side panel 14 adjoin the rear panel 12 on the left and the front panel 13 on the right.

Further blank parts which form an end panel 18 adjoin above the aforedescribed series of blank parts 12 to 16. These further parts are, from left to right, a side tab 19, an outer cover tab 20 (connected to the rear panel 12), a side tab 21, an inner cover tab 22 (above the front panel 13) and a side tab 23 which forms an extension of the longitudinal tab 16. In a very similar manner, blank parts which form a bottom panel 24 adjoin the opposite end of the blank parts 12 to 16. These parts are a side tab 25, an outer cover tab 26 (connected to the rear panel 12), a side tab 27, an inner cover tab 28 (connected to the front panel 13) and a side tab 29.

Figure 2:
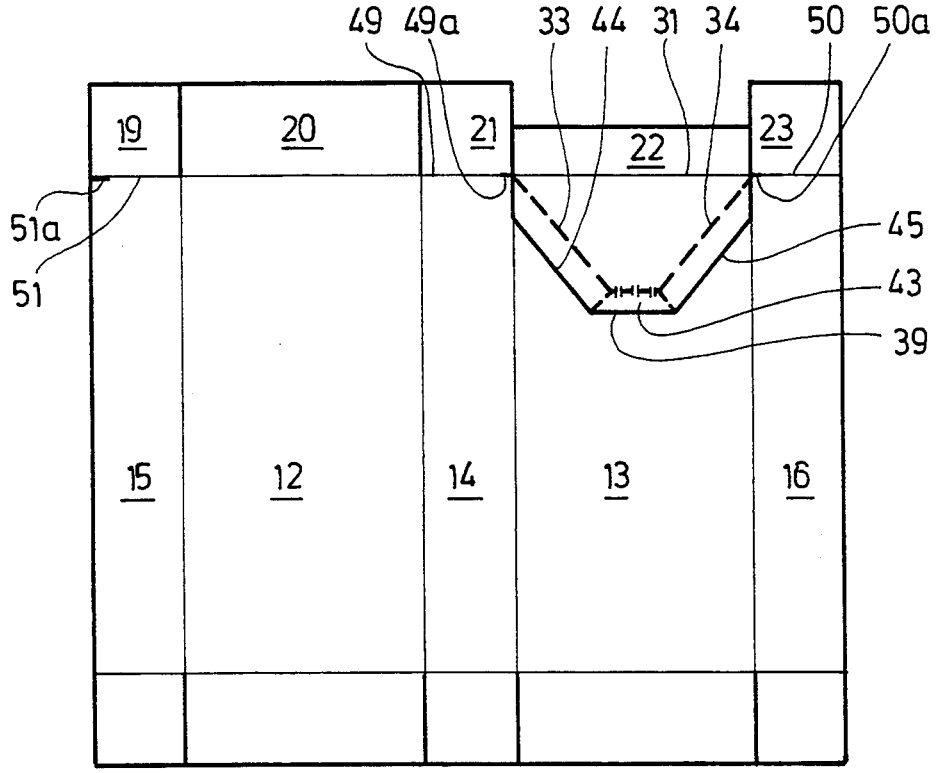
FIG. 2 shows the blank of FIG. 1 after a process step has been completed, i.e. with a downwardly folded closure tab.

The thin lines in FIGS. 1 and 2 illustrate future folding lines, which may be prepunched if required, whereas the thicker lines illustrate the outline and incisions. A special feature can be seen in the region of the front panel 13, in particular between this front panel and the inner cover tab 22 located above the front panel. In this region, there is disposed an approximately trapezoidal closure tab 30 which is separated from the inner cover tab 22 by a folding line 31.

Apart from this line, the closure tab 30 is detached from the blank 10, especially by means of punch cuts 33, 34, with the except ion of a residual connection 32. The punch cuts 33, 34 form continuations of incisions 33*a*, 34*a* and extend from the points of contact 35, 36 which are directed towards the front panel 13 and are located between the side tabs 21 and the side panel 14, and between the side tab 23 and the longitudinal tab 16. From these points of contact 35, 36, the punch cuts 33, 34 extend in the direction towards the inner cover tab 28 or the bottom panel 24 in a converging manner. In the region of incision ends 37, 38, the punch cuts 33, 34 are finally connected by the residual connection 32 which has already been mentioned.

Additionally, the punch cuts 33, 34 are connected to one other by a transversely directed folding line 39 a short distance above the residual connection 32. The function of this folding line is evident in conjunction with FIG. 2. When the pack according to the invention is produced, the inner folding tab 22 is offset downwardly, by a distance which is twice he distance between the folding line 39 and the residual connection 32, by way of a downward folding of the closure tab 30 along the residual connection 32 and an upward folding along the folding line 39. Now, the folding line 31 terminates at the points of contact 35, 36.

Before the blank is folded as described above, a durably effective adhesive is applied, for example in the form of a hot-melt 41, 42 (see FIG. 4), preferably in the region of the punch cuts 33, 34 which define a future withdrawal opening 40. The adhesive is preferably adapted such that the closure tab 30 which will rest on the adhesive at a later stage can be opened and reclosed repeatedly.

The blank 10 is preferably made of a thin paper or paper-like material which means it is particularly easy to dispose. However, it could also be made of thin cardboard, plastic foil or the like instead. The residual connection 32 is adapted to the material. It is destroyed or torn off in order to open the pack. A perforation or the like may be used for this purpose. The tearing process is facilitated by the web 43 which is formed between the residual connection 32 and the folding line 39 and which can be readily grasped with one hand.

Figure 3:
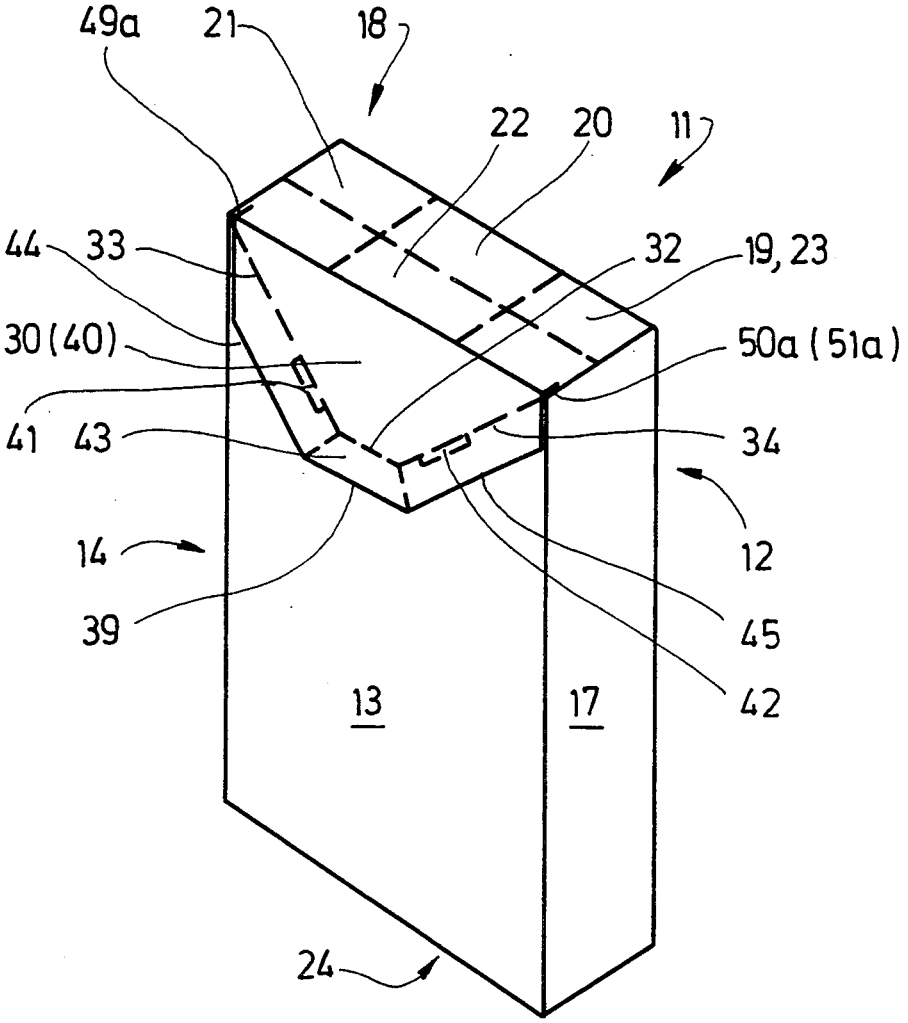
FIG. 3 shows a perspective view of a pack according to the invention in a closed state.

FIGS. 2 and 3 clearly show that the respective edges 44, 45 of the closure tab 30 overlap the punch cuts 33, 34 (indicated by broken lines) in the region of the withdrawal opening 40.

Figure 4:
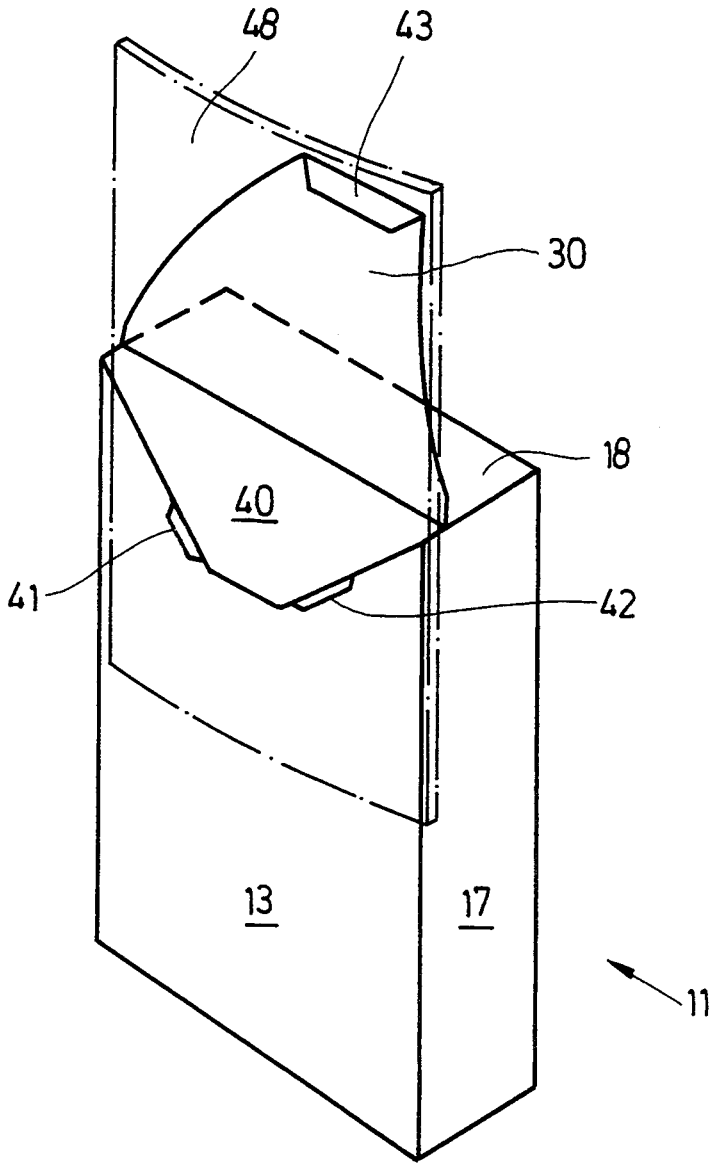
FIG. 4 shows the pack of FIG. 3, but with an opened closure tab and a partly withdrawn handkerchief.

As a result of the folding and the forming of the web 43 as described above, the inner cover tab 22 is reduced in width relative to the outer cover tab 20. The end panel is folded such that, after the forming of a wrapping which is open at both ends and in which the longitudinal tabs 15, 16 overlap in order to form the side panel 17, the side tabs 19, 21, 23, 25, 27, 29 are, first of all, folded inwards. Thereafter, the inner cover tabs 22 and 28 and, finally, the outer cover tabs 20 and 26 are folded inwards. Consequently, the outer cover tabs 20, 26 are located on the outside in the completed pack 11 as illustrated in FIGS. 3, 4. The above mentioned tabs are preferably bonded to one another adhesively.

The downward folding of the closure tab 30 and the resulting reduction of the width of the inner cover tab 22 contribute substantially to the accomplishment of the rectangular shape of the blank 10. In particular, the upper and lower blank edges 46, 47 extend rectilinearly without any interruptions. As a result, it is possible to sever the blanks 10 from a web of blanks in an extremely simple manner. At the same time, the lower region of the completed pack, i.e. the region of the bottom panel 24, is particularly stable because the side tabs 25, 27, 29 and cover tabs 26, 28 rest on top of one another in this region. This ensures a secure grasping of the pack and an overall stable package until the withdrawal of the last handkerchief.

FIG. 4 illustrates the pack 11 in the opened state, i.e. with a severed residual connection 32, a released adhesive connection (hot-melt 41, 42) and an upwardly folded closure tab 30. A handkerchief 48 which is partly withdrawn is indicated by broken lines in tile withdrawal opening 40 which is formed in this manner. To facilitate the withdrawal of the handkerchief, not only the closure tab 30 but also a small part of the adjoining end panel 18 can be folded up together with the closure tab. For this purpose, folding lines 49 and 50 which start from the points of contact 35 and 36, respectively, and are located between the side tab 21 and side panel 14 and between the side tab 23 and the longitudinal tab 16 are each provided with a short incision 49*a* and 50*a*, respectively. Because the longitudinal tabs 15, 16 and, consequently, the side tabs 19, 23 overlap, an incision 51*a* is disposed analogously to the incision 50*a* along a folding line 51 between the longitudinal tab 15 and the side tab 19. The withdrawal opening 40 is thus extend ed and permits an easy withdrawal of individual handkerchiefs 48 from the pack 11 which preferably holds ten handkerchiefs.

In a further embodiment which is not illustrated, an adhesive tape is applied to the web 43 in order to extend the closure tab 30. This adhesive tape is bonded either only to the closure tab 30 or to this closure tab and, at the same time, to the front panel 13 (when the pack 11 is closed).

What is claimed is:

1. A pack for receiving a stack of handkerchiefs made of paper, parchment, thin cardboard or foil, wherein:

a) the pack has a cuboid shape with a large front panel (13), a large rear panel (12) narrow side panels (14, 17), a narrow bottom panel (24) and a narrow end panel (18);

b) the end panel (18) is formed by at least partially overlapping folding tabs, and wherein a corresponding inner cover tab (22), which is located in the plane of the end panel (18), adjoins the front wall (13);

c) in a region of the front panel (13) adjoining the end panel (18), there is a withdrawal opening (40) which is covered by a closure tab (30);

d) for forming the withdrawal opening (40) and the closure tab (30), the front panel (13) is provided, in said region adjoining the end panel (18), with incisions (33, 34) extending in the direction of the bottom panel (24), lower ends (37, 38) of the incisions (33, 34) being connected to one another via a residual connection (32) which is provided for tearing; and e) in a closed pack, the closure tab (30), which is formed by the incisions (33, 34) and the residual connection (30), is folded downwards relative to the front panel about the width of a narrow web (43) adjoining the residual connection (32), the web (43) and the closure tab (30) adjoining in the upward direction being connected by means of a folding line.

2. The pack as claimed in claim 11, wherein the inner cover tab (22) adjoining the closure tab (30) is provided with cuts adjoining the incisions (33, 34).

3. The pack as claimed in claim 1, wherein the inner cover tab (22) adjoins the closure tab (30) via a folding line (31) and is narrower than the end panel (18) by twice the width of the web (43).

4. The pack as claimed in claim 1, wherein the incisions (33, 34), which are directed towards the bottom panel (24), at the same time converge towards one another.

5. The pack as claimed in claim 1, wherein the end panel (18) has, in a region adjoining the front panel (13), short incisions (49*a*, 50*a*, 51*a*) which extend edges (33, 34) of the closure tab (30), which are directed towards the rear panel (12), and which do not extend over the entire width of the end panel (18).

6. The pack as claimed in claim 5, wherein the closure tab (30) is at least partly connected with the front panel (13), in a repeatedly releasable manner, in regions which cover the edges (33, 34) of the withdrawal opening (40).

7. A blank for forming a cuboid pack made of paper, parchment, thin cardboard or foil, said blank having blank parts for forming a front panel, a rear panel, narrow side panels an end panel (18) and a bottom panel of said pack, wherein said parts comprise longitudinal tabs for forming the side panels, and two inner cover tabs (22, 28), which respectively form the end panel and the bottom panel, and which adjoin the front panel (13); and wherein the front panel (13) is provided with first incisions (33, 34) which define a closure tab (30);

the incisions (33, 34) have bottom ends, (37, 38) which are connected to one another by a residual connection (32) which is provided for tearing off;

a folding line (39) is located parallel to and above the residual connection (32) and defines a web with the incisions (33, 34) and the residual connection (32), the web having a width which results from the distance of the residual connection (32) from the folding line (39); and wherein the closure tab (30) and a first one (22) of the inner cover tabs are separated from one another by another folding line (31) which is located offset relative to folding lines between the longitudinal tabs (15, 16) and the adjoining side tabs (19, 21, 23) by twice the width of the web (43), said another folding line (31) thus pointing away from the web (43).

8. The blank as claimed in claim 7, wherein said first inner cover tab (22) and an outer cover tab (20), which form the end wall (18), are provided with parallel second incisions (33*a*, 34*a*) thereby forming side tabs (21, 23) adjoining the longitudinal tabs (14, 16), and wherein said parallel second incisions (33*a*, 34*a*), in a region of the from wall, extend as said first incisions (33, 34) up to the residual connection (32).

9. The blank as claimed in claim 8, wherein the second incisions (33*a*, 34*a*) are parallel to one another in a region of the first and the outer cover tabs (20, 22), extend in the region of the front panel (13) towards one another in an inclined manner and terminate in lower incision ends (37, 38) which are directed towards the bottom panel (24) and which are interconnected by said residual connection (32).

10. The blank as claimed in claim 9, wherein short incisions (49*a*, 50*a*) are disposed in a region of a transition between the from panel (13) and the side tabs (21, 23), are directed outwards and perpendicular to the parallel second incisions (33*a*, 34*a*), and adjoin the parallel second incisions (33*a*, 34*a*), said short incisions (49*a*, 50*a*) not extending over the entire width of the side tabs (21, 23), and wherein an incision (51*a*) which corresponds to the short incisions (49*a*, 50*a*) is disposed in a region of a further side tab (19) which forms the end panel (18).

11. The blank as claimed in claim 7, comprising an overall rectangular shape, but at least parallel upper and lower edges (46, 47) in a region of the blank parts provided to form the end panel (18) and the bottom panel (24).

12. A cuboid pack, for receiving a stack of handkerchiefs made of paper, parchment, thin cardboard or foil, and having a front panel, a rear panel, side panels, an end panel, a bottom panel and a closure tab which covers a withdrawal opening at least in a region of the front panel, said closure tab being connected to pack parts, which form the end panel, and at least partially covering edges of the withdrawal opening, characterized in that there is a residual connection (32) between the closure tab (30) and a portion of the edges (33, 34) of the withdrawal opening (40), said residual connection being tearable in order to open the pack (11);

said pack comprising first incisions (33, 34) extending in a direction towards the bottom panel (24) in order to form the closure tab (30) in a front panel region which adjoins the end panel (18);

wherein incision ends (37, 38) which are directed towards the bottom panel (24) are connected to one another by the tearable residual connection (32); and wherein the end panel (18) has, in a region adjoining the front panel (13), short incisions (49*a*, 50*a*, 51*a*) which extend edges (33, 34) of the closure tab (30), which are directed towards the rear panel (12), and which do not extend over the entire width of the end panel (18).

13. The pack as claimed in claim 12, wherein the first incisions (33, 34), which are directed towards the bottom panel (24), at the same time converge towards one another.

14. The pack as claimed in claim 12, wherein the closure tab (30) is folded, starting from the front panel (13) in a direction towards the end panel (18) in a region of the tearable residual connection (32), with a short intermediate piece (43) outwards and downwards—towards the bottom panel (24)—, and from a lower edge (39) of the intermediate piece (43) upwards towards the end panel (18).

15. A cuboid pack, for receiving a stack of handkerchiefs made of paper, parchment, thin cardboard or foil, and having a front panel, a rear panel, side panels, an end panel, a bottom panel and a closure tab which covers a withdrawal opening at least in a region of the front panel; said closure tab being connected to pack pans, which form the end panel, and at least partially covering edges of the withdrawal opening; characterized in that there is a residual connection (32) between the closure tab (30) and a portion of the edges (33, 34) of the withdrawal opening (40), said residual connection being tearable in order to open the pack (11);

wherein the closure tab (30) is at least partly connected with the front panel (13), in a repeatedly releasable manner, in regions which cover the edges (33, 34) of the withdrawal opening (40).

16. A blank for forming a cuboid pack made of paper, parchment, thin cardboard or foil, said blank having blank parts for forming a front panel, a rear panel, side panels, an end panel and a bottom panel, in which longitudinal tabs for forming the side panels and cover tabs for forming the end panel and the bottom panel adjoin the from panel, wherein the front panel (13) has first incisions (33, 34) for forming a closure tab (30), and wherein the cover tabs (20, 22) have parallel second incisions (33*a*, 34*a*) for forming the end panel (18), thereby forming side tabs (21, 23) adjoining the longitudinal tabs (14, 16), and wherein the parallel second incisions (33*a*, 34*a*) extend in a region of the front panel as said first incisions (33, 34);

wherein the second incisions (33*a*, 34*a*) are parallel to one another in a region of the cover tabs (20, 22), extend in the region of the from panel (13) towards one another in an inclined manner and terminate in lower incision ends (37, 38) which are directed towards the bottom panel (24) and which are interconnected by said residual connection (32);

wherein short incisions (49*a*, 50*a*) are disposed in a region of a transition between the from panel (13) and the side tabs (21, 23), are directed outwards and perpendicular to the parallel second incisions (33*a*, 34*a*), and adjoin the parallel second incisions (33*a*, 34*a*), said short incisions (49*a*, 50*a*) not extending over the entire width of the side tabs (21, 23), and wherein an incision (51*a*) which corresponds to the short incisions (49*a*, 50*a*) is disposed in a region of a further side tab (19) which forms the end panel (18).

17. The blank as claimed in claim 16, comprising an overall rectangular shape, but at least parallel upper and lower edges (46, 47) in a region of the blank parts provided to form the end panel (18) and the bottom panel (24).

* * * * *